United States Patent [19]

Ikeda

[11] Patent Number: 4,634,819

[45] Date of Patent: Jan. 6, 1987

[54] MOVABLE CONTACT ASSEMBLY FOR A SWITCH

[75] Inventor: Kosaku Ikeda, Nagoya, Japan

[73] Assignee: Mitsubishi Denki Kabushiki Kaisha, Tokyo, Japan

[21] Appl. No.: 746,319

[22] Filed: Jun. 19, 1985

[30] Foreign Application Priority Data

Jun. 20, 1984 [JP] Japan ..... 59-90684[U]

[51] Int. Cl.[4] ..... H01H 1/20; H01H 15/04

[52] U.S. Cl. ..... 200/16 A; 200/243; 200/280

[58] Field of Search ..... 200/16 A, 164, 237–239, 200/243–250, 280, 281

[56] References Cited

U.S. PATENT DOCUMENTS

| | | | |
|---|---|---|---|
| 3,170,054 | 2/1965 | Lawrence et al. | 200/16 A |
| 3,238,341 | 3/1966 | Haydu | 200/16 A |
| 3,272,949 | 9/1966 | Lawrence | 200/243 |
| 3,320,392 | 5/1967 | Mullen et al. | 200/243 |
| 3,336,455 | 8/1967 | Turnbull et al. | 200/243 X |
| 3,436,497 | 4/1969 | Mading | 200/16 A |
| 4,195,212 | 3/1980 | Graham et al. | 200/243 |
| 4,224,489 | 9/1980 | Dietrich | 200/16 A |
| 4,262,179 | 4/1981 | Bauer | 200/243 X |
| 4,450,328 | 5/1984 | Nishizako et al. | 200/144 R |
| 4,453,057 | 6/1984 | Streich et al. | 200/243 |

FOREIGN PATENT DOCUMENTS

| | | | |
|---|---|---|---|
| 0080939 | 6/1983 | European Pat. Off. | 200/243 |
| 1154553 | 9/1963 | Fed. Rep. of Germany | 200/243 |
| 1121255 | 3/1966 | United Kingdom | 200/280 |

*Primary Examiner*—J. R. Scott

*Attorney, Agent, or Firm*—Leydig, Voit & Mayer, Ltd.

[57] ABSTRACT

A movable contact assembly comprises a movable contact arm carrying a movable contact element, an electrically insulating contact holder for holding the movable contact arm and movable between the open and closed positions, a compression spring for resiliently holding the movable contact arm relative to the contact holder, and a spring retainer disposed between the compression spring and the movable contact arm. The spring retainer has first and second sloped guiding surfaces. The movable contact arm has first and second sloped guided surfaces thereon. The sloped guide surfaces of the spring retainer serve to guide, in cooperation with the sloped guided surfaces of the movable contact arm, the movable contact arm into a predetermined proper positional relationship relative to the movable contact holder due to the spring force of the compression spring.

5 Claims, 8 Drawing Figures

MOVABLE CONTACT ASSEMBLY FOR A SWITCH

BACKGROUND OF THE INVENTION

This invention relates to a movable contact assembly for an electric switch.

FIGS. 1 and 2 show in sectional views one example of a movable contact assembly for use in an electromagnetic contactor of the type disclosed in U.S. Pat. Nos. 4,450,328 and 3,320,392. In the figures, an electrically insulating, linearly-movable contact holder 1 of a conventional movable contact assembly has a movable contact arm 2 held in a through hole 1*a* formed in the holder 1. A stationary contact assembly 6 is provided opposite the movable contact assembly and includes the stationary contact elements 6*a* on both sides.

The movable contact arm 2 is made of an electrically conductive elongated rigid sheet having movable contact elements 2*a* mounted on its opposite ends. The movable contact arm 2 generally resembles section of a shallow dish having a flat central portion 2*b*. From each of the opposite ends of the central portion 2*b*, an upwardly inclined portion 2*c* extends at an angle to form, together with the flat central portion 2*b*, a shallow "U". A horizontal outer portion 2*d* carrying thereon a movable contact element 2*a* extends from the outer ends of each of the inclined portions 2*c* parallel to the flat central portion 2*b*.

The movable contact holder 1 has within its through hole 1*a* a downward projection 1*b* and a flat support surface 1*c* on which the flat central portion 2*b* of the movable contact arm 2 is placed. The movable contact arm 2 is resiliently held in place by a compression spring 4 disposed between the downward projection 1*a* and a spring retainer 3 positioned in the central portion 2*b* of the movable contact arm 2. The spring retainer 3 is provided with rounded lower corners which fit the corners or bent portions between the flat central portion 2*b* and the inclined portions 2*c* as shown in FIG. 1.

During assembling of the movable contact assembly, if the movable contact arm 2 is mislocated or placed in the slanted position in the through hole 1*a* of the contact holder 1 by a certain predetermined amount, the compression spring, together with the guiding action between the spring retainer 3 and the U-shaped configuration of the movable contact arm 2, act to automatically return the movable contact arm 2 to its proper position shown in FIG. 1.

However, when the misplacement exceeds a predetermined amount, the movable contact arm 2 can easily become caught in the position shown in FIG. 2, in which the movable contact arm 2 slants with respect to the contact holder 1 and engages with the holder 1 at one of the corners of the "U" and the movable contact element 2*a*, and the movable contact arm 2 is held in this displaced position by the action of the compression spring 4 through the spring retainer 3 which engages with the movable contact arm 2 at its corners.

SUMMARY OF THE INVENTION

Accordingly, an object of the present invention is to provide a movable contact assembly for a switch which can automatically correct the alignment between a contact holder and a movable contact arm even when the contact arm is displaced by a large amount.

Another object of the present invention is to provide a movable contact assembly for a switch which can be easily assembled.

With the above objects in view, a movable contact assembly of the present invention for use with a stationary contact assembly of an electric switch including a stationary contact element comprises a movable contact arm carrying a movable contact element, an electrically insulating contact holder for holding the movable contact arm which is movable between the contact open and closed positions, a compression spring for resiliently holding the movable contact arm relative to the contact holder, and a spring retainer disposed between the compression spring and the movable contact arm. The spring retainer has first and second sloped guiding surfaces. The movable contact arm has first and second sloped guided surfaces thereon. The sloped guide surfaces of the spring retainer serve to guide, in cooperation with the sloped guided surfaces of the movable contact arm, the movable contact arm into a predetermined proper positional relationship relative to the movable contact holder due to the spring force of the compression spring.

DESCRIPTION OF THE PREFERRED EMBODIMENTS

Referring now to FIGS. 3 to 8 in which one embodiment of the present invention is illustrated, the movable contact assembly of the present invention comprises an electrically insulating, linearly movable contact holder 1 having a movable contact arm 12 held in a through hole 1*a* formed in the holder 1.

The movable contact arm 12 is made of an electrically conductive, elongated rigid sheet having movable contact elements 12*a* mounted on its opposite ends. The cross-sectional shape of the movable contact arm 12 generally resembles the cross-sectional shape of a flat-bottomed dish. It has a flat central portion 12*b* from which shaped portions 12*c* rise upwardly at either end. The shaped portions 12*c* both have the same angle with respect to the flat central portion 12*b*. From each of the opposite ends of the central portion 12*b*, an upwardly inclined portion 12*c* extends at an angle to form, together with the flat central portion 12*b*, a shallow "U". A horizontal outer portion 12*d* carrying thereon the movable contact element 12*a* extends from the outer ends of each of the inclined portions 12*c* parallel to the flat central portion 12*b*. According to the present invention, the movable contact arm 12 has a projection 12*e* secured to or formed in the upper surface of the flat central portion 12*b*. The purpose of this projection will be explained later on.

The movable contact holder 1 has within its through hole 1*a* a downward projection 1*b* and a flat support surface 1*c* on which the flat central portion 12*b* of the movable contact arm 12 rests. The movable contact arm 12 is resiliently held in place by a compression spring 4 disposed between the downward projection 1*a* and a spring retainer 13 positioned in the flat central portion 12*b* of the movable contact arm 12.

Figure 6:
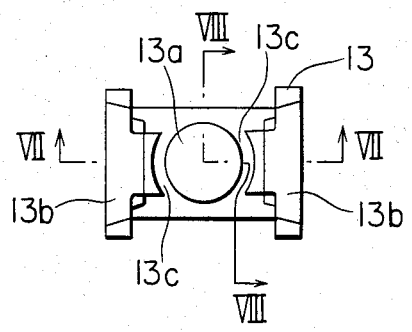
FIG. 6 is a plan view of the spring retainer.
Figure 7:
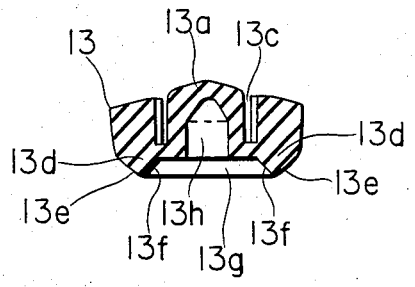
FIG. 7 is a sectional view taken along Line VII—VII of FIG. 6.
Figure 8:
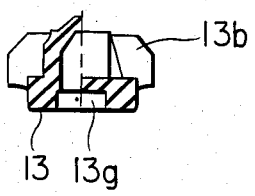
FIG. 8 is a sectional view taken along Line VIII—VIII of FIG. 6.

As best seen in FIGS. 6 to 8, the spring retainer 13 may be made of an electrically insulating material such as plastic. The spring retainer 13 is generally rectangular in plan as shown in FIG. 6 and is provided at its center with a cylindrical boss or projection 13*a* for supporting one end of the spring 4 therearound. The spring retainer 13 is also provided at its opposite ends with a pair of seat portions 13*b* which are separated from the projection 13*a* by a pair of arcuated grooves 13*c* which receive in the spring 4 therein. At the bottom of the spring retainer 13 is provided a pair of parallel spaced ridges 13*d* each having triangular cross section defining a sloped outer guide surface 13*e* and a sloped inner guide surface 13*f* disposed in a back-to-back relationship to the outer guide surface 13*e*. In the illustrated embodiment, the triangular ridges 13*d* are also provided along the sides of the spring retainer 13, so that a recess 13*g* which is rectangular in plan is defined by the surrounding ridges. The rectangular recess 13*g* is further provided with a cavity 13*h* for decreasing the weight of the spring retainer 13.

Figure 1:
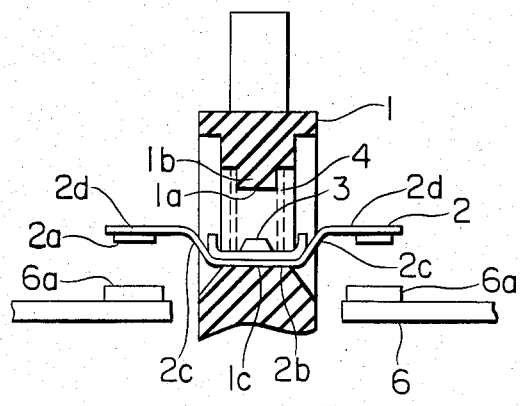
FIG. 1 (PRIOR ART)
FIG. 1 is a cross-sectional view of a conventional movable contact assembly.

Although not illustrated, the lower portion of the movable contact holder 1 is associated with a plunger of an electromagnet as is well known and is linearly movable in the direction parallel to its longitudinal axis. When the electromagnet is deenergized, the movable contact assembly is held in its open position shown in FIG. 1 by the action of an unillustrated spring means well known in the art. In the open contact position, the movable contact elements 12*a* are separated from stationary contact elements 6*a* secured on stationary contact conductors 6 rigidly secured in the housing of the switch. When the electromagnet (not shown) is energized, the movable contact assembly is moved downward against the action of the spring means (not shown), lowering the movable contact elements 12*a* onto the movable contact arm 12 and into electrical contact with the stationary contact elements 6*a*. In this closed contact position, the compression spring 4 provides a sufficient pressure to obtain good contact between the contact elements 12*a* and 6*a*.

Figure 3:
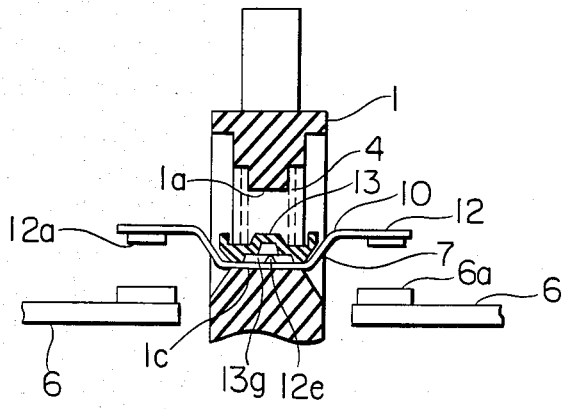
FIG. 3 is a fragmental sectional view of the movable contact assembly of the present invention.
Figure 2:
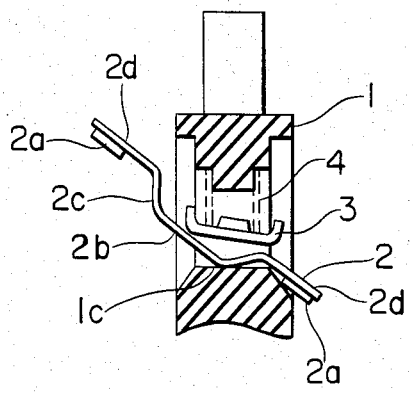
FIG. 2 (PRIOR ART)
FIG. 2 is a cross-sectional view of the movable contact assembly illustrating the condition in which the movable contact arm is caught out of place during assembling.
Figure 4:
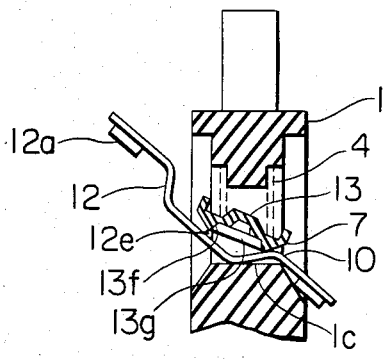
FIG. 4 is a view similar to FIG. 3 but illustrating the condition in which the movable contact arm is being guided into the proper position.
Figure 5:
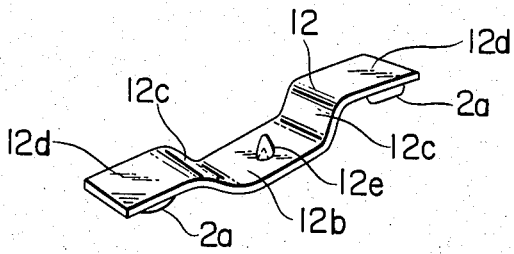
FIG. 5 is a perspective view of the movable contact arm.

During assembly of the movable contact assembly, even when the movable contact arm 12 is mislocated or placed in the slanted position in the through hole 1*a* of the contact holder 1 as shown in FIG. 4, the force of the compression spring 4, together with the guiding action provide by the spring retainer 13 acts to automatically return the movable contact arm 12 to its proper position shown in FIG. 3. More particularly, contrary to the conventional design illustrated in FIGS. 1 and 2, means are provided for guiding the movable contact arm 12 into operative positional relationship relative to the movable contact holder 1 under the spring force of the compression spring 4. For this purpose, the spring retainer 13 has ridges 13*d* defining a laterally spaced pair of outer and inner sloped guiding surfaces 13*e*, 13*f* and the movable contact has the projection 12*e* and sloped portions 12*c* providing means defining sloped guided surfaces facing the guiding surfaces 13*e*, 13*f* of the spring retainer 13. Accordingly, when the movable contact arm 12 is positioned relative to the contact holder 1 in the manner shown in FIG. 4 during assembly, the inner guiding surface 13*f* of one of the ridges 13*d* is in contact with the projection 12*e* of the movable contact arm 2, and the outer guiding surface 13*e* of the other of the ridges 13*d* is in contact with one of the sloped portions 12*c* of the movable contact arm 2. Under these circumstances, the compression spring 4 acts through the inner guiding surface 13*f* of the spring retainer 13 upon the projection 12*e* to rotate it, and therefore the movable contact arm 12 pivots counterclockwise and moves to the right as viewed in FIG. 4. Similarly, the compression spring 4 acts through the outer guiding surface 13*e* of the spring retainer 13 upon the right-hand sloped portion 12*c* of the movable contact arm 12 to produce the same effect and move the movable contact arm 12 to the left as viewed in FIG. 4. Thus, the action of the guiding surfaces 13*e* and 13*f* of the spring retainer 13 on the projection 12*d* and the sloped portion 12*c* which provide sloped guided surfaces of the movable contact arm 12 always causes the movable contact arm 12 to automatically move into the proper position with respect to the contact holder 1.

What is claimed is:

1. A movable contact assembly of a switch for use with a stationary contact assembly including stationary contact elements comprising:

movable contact elements engageable with the stationary contact elements;

a movable contact arm carrying said movable contact elements;

an electrically insulating contact holder movable between open and closed positions, said contact holder holding said movable contact arm;

a compression spring for resiliently holding said movable contact arm relative to said contact holder;

a spring retainer disposed between said compression spring and said movable contact arm;

means for guiding said movable contact arm into a predetermined operative positional relationship relative to said movable contact holder under the spring force of said compression spring including means on said spring retainer defining a laterally spaced pair of first and second oppositely facing sloped guiding surfaces;

means on said movable contact arm defining a pair of first and second sloped guided surfaces facing said pair of first and second guiding surfaces of said spring retainer;

said sloped guiding surfaces of said spring retainer, in cooperation with the sloped guiding surfaces of said movable contact arm, guiding said movable contact arm into a predetermined operative positional relationship relative to said movable contact holder due to the spring force of said compression spring.

2. A movable contact assembly as claimed in claim 1 wherein said spring retainer has a pair of ridges of a triangular cross section, outer and inner surfaces of each of said ridges defining said pair of first and second guiding surfaces, and said movable contact arm has a pair of sloped portions and a projection providing said pair of first and second sloped guided surfaces.

3. A movable contact assembly as claimed in claim 2, wherein said movable contact arm has a symmetric shape about the central axis of the assembly, said movable contact elements are secured on the opposite ends of said movable contact arm, and said projection is disposed on the center of said movable contact arm.

4. A movable contact assembly as claimed in claim 1 wherein said spring retainer has a recessed portion having at least two sloped surfaces inside of said recessed portion defining at least said second sloped guiding surfaces, and another sloped surface having an inclination different from that of said first-mentioned sloped surface on the outside of said recessed portion defining one of said first sloped guiding surfaces.

5. A movable contact assembly as claimed in claim 1 wherein said compression spring is a coil spring and said spring retainer has formed therein a groove for receiving therein one portion of said compression spring.

* * * * *